United States Patent [19]

Chen et al.

[11] Patent Number: 4,871,444

[45] Date of Patent: Oct. 3, 1989

[54] DISTILLATE FUEL QUALITY OF FCC CYCLE OILS

[75] Inventors: Nai Y. Chen, Titusville; Billy K. Huh, Lawrenceville; Anil B. Ketkar, Cranbury; Chaya Venkat, Princeton, all of N.J.

[73] Assignee: Mobil Oil Corporation, New York, N.Y.

[21] Appl. No.: 271,398

[22] Filed: Nov. 10, 1988

Related U.S. Application Data

[63] Continuation of Ser. No. 127,306, Dec. 2, 1987, abandoned.

[51] Int. Cl.[4] ..... C10G 71/00

[52] U.S. Cl. ..... 208/46; 44/57; 585/467

[58] Field of Search ..... 208/46; 44/57

[56] References Cited

U.S. PATENT DOCUMENTS

| | | | |
|---|---|---|---|
| 4,021,331 | 5/1977 | Ciric | 585/486 |
| 4,301,316 | 11/1981 | Young | 585/467 |
| 4,570,027 | 2/1986 | Boucher et al. | 585/467 |
| 4,594,143 | 6/1986 | Tabak | 208/46 |

*Primary Examiner*—Curtis R. Davis

*Attorney, Agent, or Firm*—Alexander J. McKillop; Charles J. Speciale; Malcolm D. Keen

[57] ABSTRACT

A method for improving the cetane number of an aromatic hydrocarbon oil such as FCC light cycle oil and thereby increase its value as a blending stock for diesel fuel or heating oil. In one embodiment, the FCC light cycle oil is alkylated in the presence of a solid acidic catalyst and with a linear mono-olefin having a chain length of at least five carbon atoms. In another embodiment, the light cycle oil is alkylated with an olefin having three to nine carbon atoms or a mixture thereof and with ZSM-20 as catalyst to decrease the frequency of catalyst regeneration.

4 Claims, 3 Drawing Sheets

DISTILLATE FUEL QUALITY OF FCC CYCLE OILS

This is a continuation of copending application Ser. No. 127,306, filed on Dec. 2, 1987, and now abandoned.

FIELD OF THE INVENTION

This invention is concerned with improving the burning quality of hydrocarbon oils rich in polycyclic aromatic hydrocarbons, such as Fluid Catalytic Cracking (FCC) cycle oils and the like. In particular, this invention provides an improved process for alkylating such oils to provide diesel and heating oil stocks of improved cetane value. In another embodiment, this invention provides a novel alkylated FCC cycle oil composition.

BACKGROUND OF THE INVENTION

Petroleum distillates comprise fractions which boil within the range of about 221° C. to 485° C., obtained by the atmospheric or vacuum distillation of crude oil. Light gas oil (221° C.-343° C.) after hydrorefining and/or fractionation may be used as fuel in diesel engines, jet planes or for home heating oil. Heavy gas oils (343° C.-565° C.) may be used as boiler fuels or else treated by catalytic cracking to produce high octane motor gasoline. In those instances where petroleum distillate fractions are utilized as fuels, it becomes necessary to meet fuel specifications, particularly with respect to pour point and ignition quality.

Ignition quality of petroleum distillates such as diesel fuel is related to the delay encountered between injection and combustion of the fuel in a diesel engine. The ignition delay period is an important factor in diesel engine combustion. A long delay period at high engine loads results in a rapid increase in pressure when the fuel starts to burn. The rate of pressure rise may become so rapid at high engine loads that knock, and/or rough engine operation, occurs. By way of explanation, it is generally believed that a long delay period allows more time for certain chemical reactions to take place in the combustion chamber before ignition occurs. These reactions result in products that burn very rapidly, causing excessively rapid pressure rise. With a short delay period, ignition apparently occurs before these reactions have proceeded far enough to cause too rapid burning. Also, with a cold engine and low intake-air temperatures, too long a delay period produces misfiring and uneven or incomplete combustion, with consequent white smoke and loss of power. Although the ignition delay time is influenced by engine operating conditions, it is known that this time for straight-run distillates depend primarily on the hydrocarbon composition of the fuel and, to a lesser extent, on its volatility characteristics. A fuel that exhibits a long delay period is said to have poor ignition quality.

The ignition quality of diesel fuel may be quantified by various methods including, for example, determining the temperature ($T_{20}$) needed to produce a twenty second ignition delay; and by its Cetane Number, as determined by ASTM. These two measures of burning quality (with the possible exception for n-alkanes noted below) appear to correlate well. U.S. Pat. No. 4,549,815 to Venkat et al. describes an apparatus and method for measuring the cetane quality of a distillate fuel by measuring the temperature required for a twenty-second ignition delay, hereinafter referred to as the $t_{20}$ ignition temperature. In accordance with that invention, the ignition delay of distillate fuel is measured by apparatus which includes a block having an ignition cavity. The block is heated to an elevated temperature above the ignition temperature of the fuel and then allowed to cool slowly. As it cools, samples of fuel are injected into the ignition cavity at times which are controlled by a digital computer. A pressure transducer and a thermocouple measure the pressure and temperature, respectively, in the cavity. For each injected sample, the digital computer measures ignition delay as the time between injection of a sample and ignition as indicated by a peak in measured cavity pressure or cavity temperature. The ignition delay is recorded as a function of the cavity temperature prior to fuel injection.

Using the temperature required for a given ignition delay, the cetane rating of distillate fuels may be estimated from a calibration curve established by comparing unit data with results from the ASTM cetane number test. It has been found that the ignition temperatures of the tested distillate fuels fall n a smooth correlation curve which can be used to provide cetane number estimates for unknown fuels. These estimates are in excellent agreement with observed ASTM values. The entire content of U.S. Pat. No. 4,549,815 is incorporated herein by reference as if fully set forth. In general, all references made herein to ignition quality, unless explicitly stated to be otherwise, are to be understood as referring to that quality determined by measurement of the $t_{20}$ temperature as described in U.S. Pat. No. 4,549,815 or equivalent, and to the estimate of cetane number derivable therefrom. It is noted that n-alkanes have been reported to have longer ignition time (i.e. higher $t_{20}$ temperature and lower calculated cetane value) than conventional diesel fuel of similar cetane number. (See M. Fortnagel et al.; Proceedings of American Petroleum Institute, Refining Dept. 61, pp 43-53, 1982.) However, since the present invention is not concerned with n-alkane feeds, this deviation is deemed to be not relevant.

In general, aromatic hydrocarbons are reputed to be of low ignition quality, while paraffins are believed to have high ignition quality. Thus, it is apparent that the base stocks used in blending to make diesel fuels are important in determining ignition quality. The refiner is constantly faced with the problem of blending stocks to achieve adequate ignition quality without sacrificing other necessary characteristics, such as pour point and volatility.

In the past, it has been known to upgrade the ignition quality of low quality cracked petroleum distillate such as FCC cycle oils by adding a blending component such as a straight-run gas oil fractions. However, the amount of FCC cycle oil, usually of high aromatic content, that may be used as a blending stock is severely limited because its inclusion in any substantial quantity causes excessive deterioration of the ignition quality of the blend.

That aromatic hydrocarbons can be alkylated by olefins in the presence of an acid catalyst is known. Such catalysts include conventional Lewis acids such as aluminum chloride and a variety of large pore size crystalline zeolites. In general, with propylene or higher olefins, the reaction proceeds in accordance with Markownikoff's rule, i.e. the aromatic moiety reacts with the olefin at the carbon atom having the least hydrogen, with no substantial formation of n-alkyl aromatic product.

U.S. Pat. No. 4,021,331 to Ciric broadly describes the catalytic conversion of organic compounds by zeolite ZSM-20. The patent includes a description of the preparation and properties of the zeolite ZSM-20. U.S. Pat. No. 4,570,027 to Boucher et al. describes a process for alkylating aromatic hydrocarbons with olefins using partially collapsed zeolite catalyst. U.S. Pat No. 4,301,316 to Young describes the synthesis of phenyldodecane by reaction of 1-dodecene and benzene, catalyzed by mazzite, Zeolite Beta, ZSM-20, ZSM-38 and isotypes thereof. The foregoing patents are incorporated herein by reference for background purposes.

It is an object of the present invention to provide a process for upgrading the quality of FCC cycle oil as blending stock for diesel fuel and heating oil. It is a further object to provide a catalytic process for alkylating FCC cycle oil with olefins wherein catalyst aging is reduced. I is a still further object to provide a process for alkylating FCC cycle oil with linear olefins thereby achieving much enhanced ignition quality. These and other objectives will become evident on reading this entire specification including the appended claims.

BRIEF SUMMARY OF THE INVENTION

One embodiment of this invention provides a method for improving the ignition quality of a petroleum oil boiling within the range of about 150° C. (350° F.) to about 288° C. (550° F.), said oil having an aromatic hydrocarbon content determined by silica gel separation of at least about 50 wt %, which method comprises:

contacting said oil and an olefin having three to about nine carbon atoms or a mixture thereof with a catalyst comprising a zeolite having the crystal structure of ZSM-20, said contacting being conducted under conditions effective to alkylate said aromatic hydrocarbons with said olefin; and recovering a hydrocarbon oil having improved ignition quality.

In another embodiment, this invention provides a method for improving the ignition quality of a petroleum oil boiling within the range of about 150° C. (350° F.) to about 288° C. (550° F.), said oil having an aromatic hydrocarbon content determined by silica gel separation of at least about 50 wt %, which method comprises:

contacting said oil and a linear olefin having a chain length of five to nine carbon atoms or a mixture thereof with a solid acid catalyst comprising a large pore zeolite, said contacting being conducted under conditions effective to alkylate said aromatic hydrocarbons with said olefin; and recovering a hydrocarbon oil having improved ignition quality.

DETAILED DESCRIPTION, PREFERRED EMBODIMENTS AND BEST MODE

FEEDSTOCK

Figure 1:
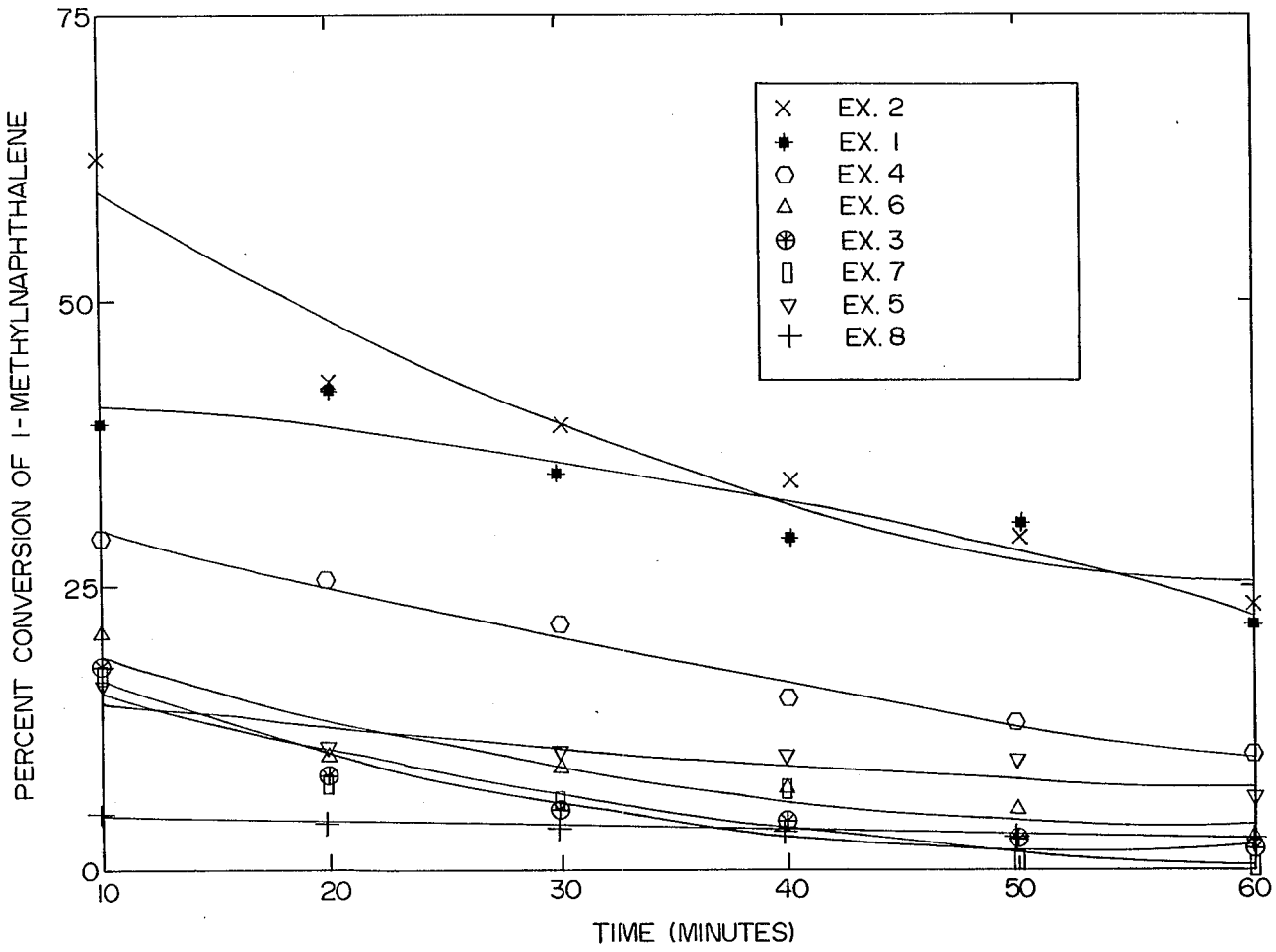

The hydrocarbon feeds used in the present process are hydrocarbon fractions which are highly aromatic and hydrogen deficient. They are fractions which have been substantially dealkylated, as by a catalytic cracking operation, for example, in an FCC or TCC unit. It is a characteristic of catalytic cracking that the alkyl groups, generally bulky, relatively large alkyl groups (typically but not exclusively $C_5$–$C_9$ alkyls), which are attached to aromatic moieties in the feed become removed during the course of the cracking. The dealkylation products from the long chain alkyl benzenes normally are included in the gasoline pool. The heavier dealkylated polynuclear aromatics form what is termed "FCC recycle oil" which is difficult to crack further. The mechanisms of acid-catalyzed cracking and similar reactions remove side chains of greater than 5 carbons while leaving behind short chain alkyl groups, primarily methyl, but also ethyl groups on the aromatic moieties. Thus, the "substantially dealkylated" cracking products include those aromatics with small alkyl groups, such as methyl, and ethyl, and the like still remaining as side chains, but with substantially no large alkyl groups, i.e. the $C_5$–$C_9$ groups, remaining. More than one of these short chain alkyl groups may be present, for example, one, two or more methyl groups.

Feedstocks that can be upgraded by the instant process have an aromatic content in excess of 50 wt %, for example, 70 wt % or 80 wt % or more, aromatics. Highly aromatic feeds of this type typically have hydrogen contents substantially below 14 wt %, usually below 12.5 wt % or even lower, e.g. below 10 wt % or 9 wt %. The API gravity is also a measure of the aromaticity of the feed, usually being below 30 and in most cases below 25 or even lower, e.g. below 20. In most cases the API gravity will be in the range of 5 to 25 with corresponding hydrogen contents from 8.5–12.5 wt %. Sulfur contents are typically from 0.5–5 wt % and nitrogen from 50–1000 ppmw.

Suitable feeds for the present process are substantially dealkylated thermal or catalytic cracking product fractions with, an end point below 650° F. (345° C.), preferably at about 288° C. (550° F.) Initial boiling point will usually be 300° F. (150° C.) or higher, e.g. 330° F. (165° C.) or 385° F. (195° C.). Light cut light cycle oils (LCOs) within these boiling ranges are highly suitable. A full range light cycle oil (FRCO) generally has a boiling point range between 385° F. and 750° F. (195° C.–400° C.). Light cycle oils generally contain from about 60% to 80% aromatics and, as a result of the catalytic cracking process, are substantially dealkylated. Other examples of suitable feedstocks include the dealkylated liquid products from delayed or fluid bed coking processes.

The appropriate boiling range fraction may be obtained by fractionation of a full range cycle oil or by adjustment of the cut points on the cracker fractionation column. The light stream will retain the highly aromatic character of the catalytic cracking cycle oils (e.g. greater than 50% aromatics by silica gel separation) but the lighter fractions used in the present process generally exclude the heavier polynuclear aromatics (PNAs - three rings or more) which remain in the higher boiling range fractions. In addition, the heteroatom contaminants are concentrated in the higher boiling fractions so that the present process is operated substantially in their absence.

The use of the dealkylated feeds is a significant feature of the process.

REACTION CONDITIONS

The alkylation of the highly aromatic feed is effected by contacting the feed and olefin with a solid, inorganic acidic catalyst, as more fully described hereinbelow, conducted under a combination of conditions of space velocity, pressure and temperature effective to induce reaction of the olefin with the aromatic constituents.

As known to one skilled in the art, specification of individual reaction parameters independently of other parameters is difficult, especially with a reversible reaction such as alkylation with olefins, since the parameters inherently interact and the entire range of one parameter (such as temperature) may not necessarily produce the invention with the entire range of a second parameter (such as pressure). In such cases, one skilled in the art would know, either from the prior art and examples contained herein, or from one or two simple experiments, to select operative combinations of parameters.

Contemplated as useful in the present invention are the following conditions, with the weight hourly space velocity (WHSV) being specified with reference to the aromatic feed:

| | WHSV | Pressure, psig | Temp., °C. |
|---|---|---|---|
| Broad | 0.05 to 50 | 0 to 1000 | 150 to 500 |
| Preferred | 0.25 to 20 | 50 to 500 | 150 to 300 |

It is particularly preferred to use as low a temperature in the 150° C.–300° C. range as is practical to effect conversion with the selected solid acidic catalyst.

Contacting may be effected batchwise or continuously with a fluid catalyst bed, a non-fluidized catalyst bed, or a transport bed of either of the foregoing types. Operation with at least a portion of the aromatic feed maintained in the liquid phase is contemplated as advantageous.

The aromatic feed to olefin may be in an approximate molar ratio of about 1 to 2 to about 10 to 1. Recovery of alkylated feed by distillation with recycle of unreacted feed is contemplated.

Embodiment A

In this embodiment of the present invention, the aromatic hydrocarbon feed is alkylated with an olefin having three to about nine carbon atoms, or a mixture thereof, in the presence of a catalyst comprising a zeolite having the crystal structure of ZSM-20. We have found that ZSM-20 shows unexpectedly high activity together with slow aging compared with other large pore zeolites when employed as catalyst in the above reaction.

The catalyst composition useful in Embodiment A of this invention (and the preferred catalyst in Embodiment B described hereinbelow) comprises the synthetic crystalline aluminosilicate designated ZSM-20. U.S. Pat. No. 4,377,721 to Chester et al. is incorporated herein by reference and is relied on for the description of the preparation, the crystal structure (including the X-ray diffraction pattern shown in Table I), the useful ion exchange forms including rare earth exchanged forms, and the description of composites with an inorganic oxide matrix, of the ZSM-20 zeolite.

EXAMPLES

Embodiment A of this invention is now described by example. This description and any other examples given herein are for illustrative purposes only and are not to be construed as limiting the scope of the invention, said scope being determined by this entire specification including appended claims.

In Examples 1–8 which follow, standard 99% pure 1-methyl was used as a model compound, and alkylation was conducted with 99% pure laboratory grade 1-butene. The alkylation experiments were done in a fixed bed, downflow reactor. Catalyst was placed in the 5/8 inch stainless steel reactor supported by equal amounts of 20-40 mesh quartz Vycor chips to fill the reactor. In all cases the catalyst loading was 5 grams. The olefin and 1-methylnaphthalene were introduced from the top with 1.25 LHSV and 770 SCF/B 1-butene circulation at 300° C. The liquid reaction products were sampled every 10 minutes.

Eight catalysts made with five different zeolites were used. Zeolite (2)–(5) are shown for comparison and are not within the scope of Embodiment A of this invention.

(1) ZSM-20 was used both without binder (Example 1) and as a composite with alumina, that contained 65 wt % zeolite (Example 2). Alpha values for fresh catalyst were 130 and 42, respectively.

(2) Hydrogen Y (H-Y) was used without binder (Example 3) and as a composite with HiSil® binder, that contained 50 wt % zeolite (Example 4). Alpha values for fresh catalyst were 4.4 (2.9 wt % Na) and 10.5, respectively.

(3) Ultra-stable Y (USY) was used as a composite with silica, that contained 65 wt % zeolite (Example 5). Its fresh alpha value was 60.

(4) Zeolite Beta was used without binder (Example 6), and as a composite with alumina, that contained 50 wt % alumina (Example 7). Fresh alpha values were 625 and 70, respectively.

(5) ZSM-5 was used as a composite with alumina, and it contained 65 wt % zeolite (Example 8). Its fresh alpha value was 220.

The preparation and properties of Zeolite X is described in U.S. Pat. No. 2,882,244, incorporated herein by reference.

The preparation and properties of Zeolite Y are described in U.S. Pat. Nos. 3,130,007; 3,264,059; 3,343,913 and 3,374,058 incorporated herein by reference.

The preparation and properties of Ultrastable Zeolite Y are described in U.S. Pat. No. 3,449,070, incorporated herein by reference.

The preparation and properties of Zeolite Beta are described in U.S. Pat. No. 3,308,069, incorporated herein by reference. Binder-free catalysts were pelleted and sieved to 400 micron particles. All catalysts were ammonium exchanged and air calcined at 538° C. for 3 hours prior to use.

FIG. 1 of the drawing summarizes the percent conversion of 1-methylnaphthalene observed in Examples 1–8. It is evident from the drawing that the ZSM-20 catalyst used in Examples 1 and showed the highest initial activities and retained a large fraction of that activity after one hour on stream. The intermediate pore-size catalyst of Example 8 showed much lower activity than any of the large pore zeolites of Examples 1–7.

Table I summarizes the selectivity data obtained for Examples 1-8. It is evident from Table I that ZSM-20 without binder (Example 1) shows outstanding selectivity. The intermediate pore size ZSM-5 catalyst of Example 8 is by far the poorest.

Figure 2:
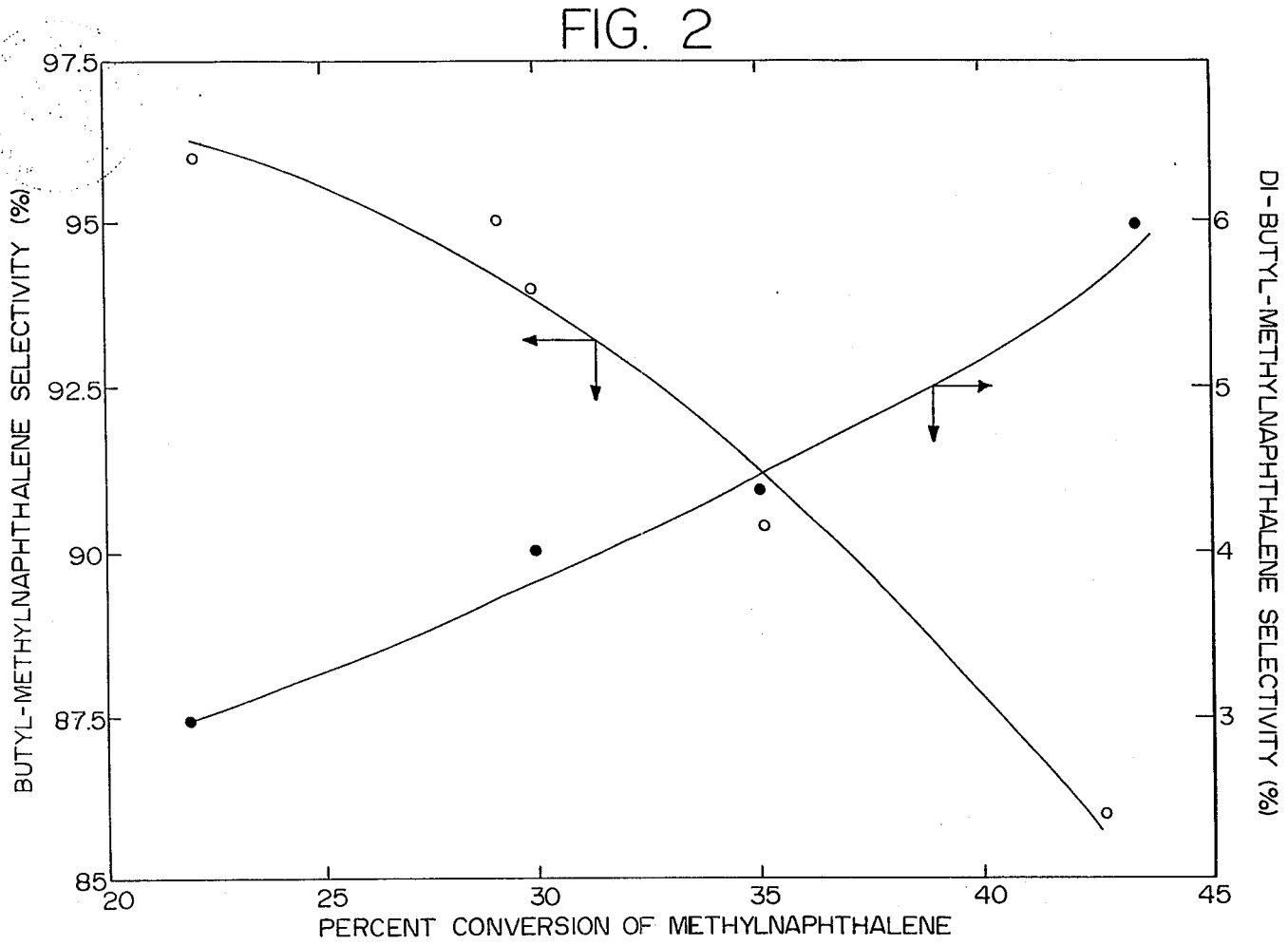

FIG. 2 of the drawing shows the change in selectivity for butyl and dibutyl methylnaphthalene with percent conversion for Example 1.

TABLE I

| | PERCENT SELECTIVITY TO BUTYL-METHYLNAPHTHALENE | | | | | | | |
|---|---|---|---|---|---|---|---|---|
| Time (min) | Ex 1 | Ex 2 | Ex 3 | Ex 4 | Ex 5 | Ex 6 | Ex 7 | Ex 8 |
| 10 | 80.3 | 60 | 28 | 84 | 28 | 45 | 80 | 12 |
| 20 | 86 | 78 | 64 | 86 | 25 | 26 | 84 | 17 |

TABLE I-continued

| | PERCENT SELECTIVITY TO BUTYL-METHYLNAPHTHALENE | | | | | | | |
|---|---|---|---|---|---|---|---|---|
| Time (min) | Ex 1 | Ex 2 | Ex 3 | Ex 4 | Ex 5 | Ex 6 | Ex 7 | Ex 8 |
| 30 | 90 | 81 | 70 | 91 | 28 | 60 | 77 | — |
| 40 | 95 | 86 | 82 | 87 | 49 | 14 | 71 | — |
| 50 | 94 | 87 | 72 | 85 | 38 | — | 60 | — |
| 60 | 96 | 77 | 90 | 84 | 50 | — | 90 | 20 |

Embodiment B

Embodiment B of this invention is based on the discovery that for monoalkyl aromatics the point of attachment of an n-butyl group can have a large effect on its $t_{20}$ temperature.

Figure 3:
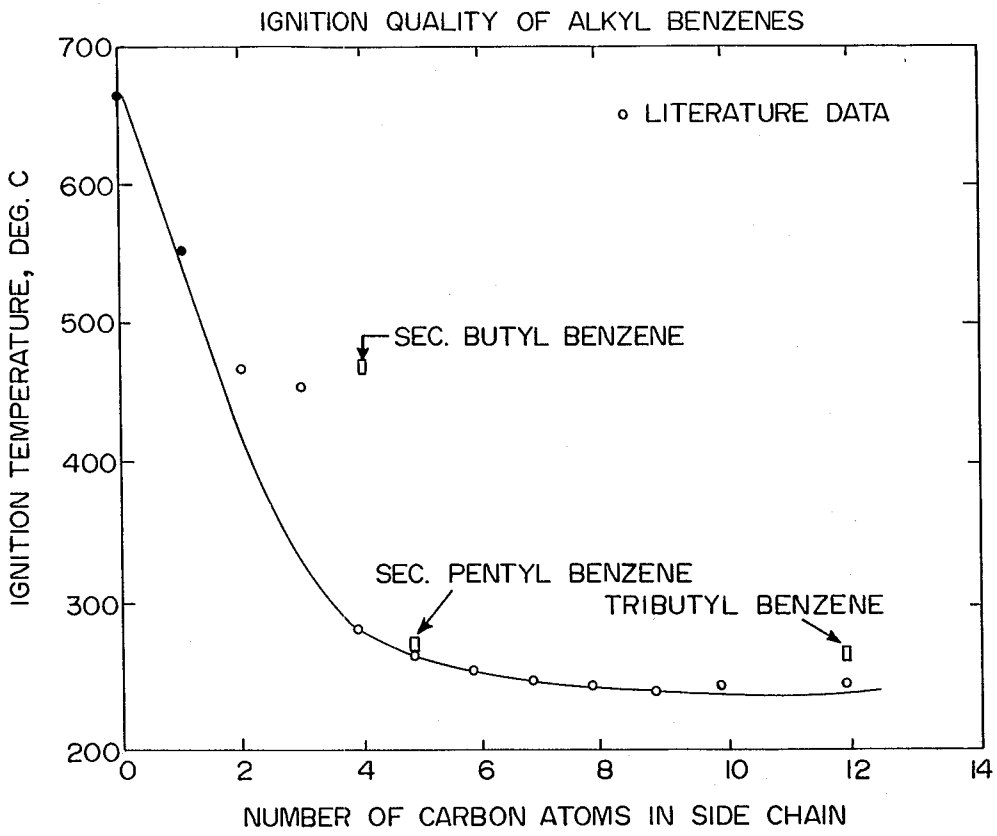

A series of model substituted alkyl benzenes were purchased, including ten n-alkyl benzenes, a sec-butyl benzene, and a 1-methylpropyl benzene. The $t_{20}$ ignition temperature of these compounds was determined by the method described hereinabove. The results are summarized in FIG. 3 of the drawing. As can be seen from FIG. 3, n-butyl benzene showed a very much lower $t_{20}$ temperature than its isomer, sec-butyl benzene, indicating a much larger effect (about two-fold) for benzene alkylation by the n-butyl group as compared with the isobutyl group. No such effect was observed, however, with n-pentyl and the isomeric 2-pentyl substituted benzenes, both compounds having about the same $t_{20}$ temperature. This behavior pattern can be summarized as follows:

(1) Aromatics substituted by an n-alkyl group of increasing carbon number have sharply lower $t_{20}$ temperatures for each carbon added until a straight chain length of four carbons is reached.

(2) Aromatics substituted by an n-alkyl group of increasing carbon number beginning with four show only a relatively small incremental decrease of $t_{20}$ temperature per carbon added.

(3) An n-alkyl group attached at the 2-position to the aromatic ring behaves, to a first approximation, like an n-alkyl group having one less carbon atom.

It is evident from the foregoing that alkylation of an aromatic feed (such as a light cut of a light cycle oil) by the method of this invention to improve its ignition quality, is most effectively conducted by acid-catalyzed alkylation with a linear olefin, preferably a 1-olefin, having a chain length of five to nine carbon atoms or a mixture thereof. Particularly preferred is alkylation with a linear 1-olefin having a chain length of five to seven carbon atoms.

It is contemplated to use as catalyst in Embodiment B of this invention an inorganic solid comprising an acidic crystalline zeolite of large pore size.

As is known in the art, the acid catalytic activity of a zeolite may be measured by its "alpha value", which is the ratio of the rate constant of a test sample for cracking normal hexane to the rate constant of a standard reference catalyst. Thus, an alpha value = 1 means that the test sample and the standard reference have about the same activity. The alpha test is described in U.S. Pat. No. 3,354,078 and in The Journal of Catalysis, Vol. IV, pp. 527–529 (Aug. 1965). Both of the foregoing descriptions are incorporated herein by reference. For purposes of the present invention it is preferred that the zeolite have an alpha value of at least about 10.

Large pore zeolites are an art-recognized class of crystalline zeolites having a framework structure characterized by windows consisting of 12-membered rings of silicon and aluminum atoms tetrahedrally bonded by oxygen bridges. Such structures characteristically exhibit a Constraint Index of less than about 1, typically 0.5 to 1.0. A method for determining the Constraint Index is described in U.S. Pat. No. 4,016,218, incorporated herein by reference, and in J. Catalysis 67, pp. 218–222 (1981) also incorporated by reference.

Large pore zeolites suitable for the catalysts of Embodiment B of this invention include Zeolite Y, Ultrastable Zeolite Y, Zeolite Beta, and ZSM-20. ZSM-20 is particularly preferred. The zeolites may be used with or without binder, and in the hydrogen, rare earth, or metal-exchanged form as described hereinabove for ZSM-20. The catalyst may be steamed in some cases to improve its selectivity.

The foregoing Embodiment B is now illustrated by example. All parts and proportions are by weight unless otherwise stated.

EXAMPLE 9

A full range (400° F.–700° F.) FCC cycle oil was distilled and the 400° F.–550° F. cut was used in this example. This cut contained 72% aromatics, 9.4% hydrogen and 5.5 bromine number. It had an estimated cetane number of 17.0. It also had 190 ppm N and 2.5% sulfur.

1-Hexene was laboratory grade, 99+% pure olefin percolated over activated alumina prior to its use in the alkylation. Alkylation was carried out in a fixed bed, vapor phase, downflow reactor. The catalyst used in this example was rare earth exchanged Zeolite X (REX). It was pelleted to ¼" Dia., ⅛" thick pellets. The pellets were calcined in dry helium at 400° C for ½ hour followed by 2 hours in 40% $O_2$ 60% $N_2$ and then cooled in flowing helium. This was done in situ in the reactor so that the catalyst was immediately used for alkylation without exposing it to the atmosphere. Following an alkylation experiment, the catalyst was regenerated by the same procedure to regain its original activity. The catalyst was placed in the 1" Dia. Vycor reactor. Equal weight of Vycor chips (80–120 mesh) was added to fill up space between catalyst pellets.

Premixed aromatic/olefin (87 wt % cycle oil, 13 wt % hexene) was then passed over the catalyst with 7500 SCF/B of helium circulation. The reaction products were collected in cold traps and analyzed by conventional procedures. The results with fresh catalyst, and with spent catalyst which had been regenerated, are shown in Table II. The olefin conversions shown for 1 hour and 3 hours TOS (time on stream) were determined from the total liquid product. All others were from instantaneous samples.

TABLE II

| Catalyst | LHSV | Temp. (°C.) | Olefin Conv. (%) | TOS |
|---|---|---|---|---|
| Fresh | 1.25 | 300 | 60 | 10 min. |
| | | | 50 | 30 min. |
| | | | 38 | 1 hr. |
| Regen. | 1.25 | 350 | 45 | ½ hr. |
| | | | 5 | 3 hr. |

EXAMPLE 10

The product from the one-hour run of Example 9 is distilled to recover a 550° F.+ fraction. The diesel index of this fraction was determined from its aniline number and gravity and compared with that of the feed and that of the 550° F.+ fraction of the FCC cycle oil. The results are shown in Table III.

TABLE III

| | Aniline No. | Diesel Index |
|---|---|---|
| FCC Cycle Oil Feed (400°-550° F.+) | <20 | <17.1 |
| FCC Cycle Oil (550° F.+) | 49 | 19.9 |
| Recovered (550° F.+) Product | 78 | 25.2 |

What is claimed is:

1. A method for improving the ignition quality of a fluid catalytic cracking cycle oil boiling within the range of about 150° C. (300° F.) to about 288° C. (550° F.), said oil having an aromatic hydrocarbon content determined by silica gel separation of at least about 50 wt %, a substantial portion of said aromatic hydrocarbons being polynuclear aromatics, which method comprises:

contacting said oil and olefin having three to about nine carbon atoms or a mixture thereof with a catalyst comprising a zeolite having the crystal structure of ZSM-20, said contacting being conducted under a combination of conditions of space velocity, temperature and pressure effective to alkylate said polynuclear aromatics with said olefin; and recovering a hydrocarbon oil having improved ignition quality.

2. The method described in claim 1 wherein said olefin is a linear olefin.

3. The method described in claim 2 wherein said olefin is a linear olefin having five to nine carbon atoms.

4. The method described in claim 3 wherein said olefin is an alpha olefin.

* * * * *